US007896517B2

(12) United States Patent
Mandy et al.

(10) Patent No.: US 7,896,517 B2
(45) Date of Patent: Mar. 1, 2011

(54) DOWNWARD ILLUMINATION ASSEMBLY

(75) Inventors: Terry Roy Mandy, Paradise Valley, AZ (US); Dalton John Mandy, Scottsdale, AZ (US); Brandon Roy Mandy, Scottsdale, AZ (US)

(73) Assignee: Man-D-Tec, Inc., Scottsdale, AZ (US)

( * ) Notice: Subject to any disclaimer, the term of this patent is extended or adjusted under 35 U.S.C. 154(b) by 355 days.

(21) Appl. No.: 12/111,516

(22) Filed: Apr. 29, 2008

(65) Prior Publication Data

US 2009/0268435 A1 Oct. 29, 2009

(51) Int. Cl.
*F21S 8/02* (2006.01)

(52) U.S. Cl. ..... 362/147; 362/148; 362/365; 362/647

(58) Field of Classification Search ..... 362/147, 362/148, 364, 365, 374, 217.01, 225, 647, 362/652, 260, 265
See application file for complete search history.

(56) References Cited

U.S. PATENT DOCUMENTS

| | | | | |
|---|---|---|---|---|
| 1,767,988 | A | | 6/1930 | Knapp |
| 2,835,791 | A | | 5/1958 | Horwitz |
| 3,189,788 | A | | 6/1965 | Cady |
| 3,336,473 | A | | 8/1967 | Buzan |
| 3,808,499 | A | | 4/1974 | Edwards |
| 4,032,828 | A | | 6/1977 | Strobl et al. |
| 4,071,749 | A | | 1/1978 | Balogh |
| 4,156,891 | A | | 5/1979 | Roche |
| 4,218,725 | A | | 8/1980 | Heffner et al. |
| 4,223,232 | A | | 9/1980 | Bulat |
| 4,241,871 | A | | 12/1980 | Newell, III et al. |
| 4,271,621 | A | | 6/1981 | Garcia et al. |
| 4,441,143 | A | | 4/1984 | Richardson, Jr. |
| 4,504,894 | A | | 3/1985 | Reibling |
| 4,520,436 | A | | 5/1985 | McNair et al. |
| 4,587,597 | A | | 5/1986 | Meyers |
| 4,674,015 | A | * | 6/1987 | Smith ..... 362/221 |
| 4,682,078 | A | | 7/1987 | Pascilade |
| 4,727,291 | A | | 2/1988 | Bavaro |
| 4,749,908 | A | | 6/1988 | Stiffer |
| 4,751,398 | A | | 6/1988 | Ertz, III |
| 4,802,065 | A | | 1/1989 | Minter et al. |
| 4,875,553 | A | | 10/1989 | Smith et al. |
| 4,890,200 | A | | 12/1989 | Mandy |
| 4,905,579 | A | | 3/1990 | Dame |
| 4,977,818 | A | | 12/1990 | Taylor et al. |
| 5,003,432 | A | | 3/1991 | Mandy |
| 5,025,349 | A | | 6/1991 | Gow |
| 5,123,875 | A | | 6/1992 | Eubank et al. |
| 5,145,247 | A | | 9/1992 | Mandy |

(Continued)

*Primary Examiner*—Thomas M Sember
(74) *Attorney, Agent, or Firm*—Reising Ethington P.C.

(57) ABSTRACT

A downward illumination assembly for directing light downward from the ceiling area of a room. A lamp housing has an open lower end positionable adjacent an opening in a ceiling panel. A power supply module is removably supported in an installed position on the housing. The power supply module carries a lamp socket such that, when the power supply module is in the installed position, a lamp plugged into the lamp socket is disposed in a position to radiate light out the lower end of the lamp housing and through an opening in a ceiling panel that the housing is mounted on. The power supply module is removable interiorly of the lamp housing through the open lower end of the lamp housing.

21 Claims, 6 Drawing Sheets

U.S. PATENT DOCUMENTS 5,253,152 A * 10/1993 Yang et al. ..... 362/221
6,102,550 A * 8/2000 Edwards, Jr. ..... 362/221
7,066,617 B2 6/2006 Mandy et al.

* cited by examiner

DOWNWARD ILLUMINATION ASSEMBLY

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to a downward illumination assembly for directing light downward from the ceiling area of a room.

2. Description of the Related Art Including Information Disclosed Under 37 CFR 1.97 and 1.98

It's well known to mount downward illumination assemblies on ceiling panels. For example, U.S. Pat. No. 5,145,247 issued 8 Sep. 1992 to Robert Mandy, discloses a downward illumination assembly including a lamp housing having a closed upper end, an open lower end disposed axially opposite the closed upper end, and a tubular canister extending from around a periphery of the upper end to and defining the open lower end. Ceiling mount tabs extend radially outward from spaced positions around an outer surface of the canister to provide engagement surfaces for fasteners connecting the lamp housing to an upper surface of a ceiling panel. The downward illumination assembly of the Mandy '247 patent may include a pair of fluorescent lamp tubes removably supported in respective lamp sockets supported within the lamp housing and a generally tubular trim bezel friction fit within the tubular canister and retained, in part, by spring clips supported on an inner surface of the canister. The downward illumination assembly disclosed in the Mandy '247 patent also may include a side conduit fitting aligned with a through hole in the canister and supported on and extending radially outward from the canister to provide access for electrical wires to the lamp sockets. However, a downward illumination assembly constructed according to the Mandy '247 patent is unable to allow for removal of a lamp socket or ballast without removing the lamp housing.

Also, U.S. Pat. No. 7,066,617 issued 27 Jun. 2006 to Terry, Dalton, and Brandon Mandy (the Mandy '617 patent), discloses a downward illumination assembly that includes a lamp housing canister having a closed upper end and a generally cylindrical canister wall extending integrally downwardly from around a periphery of the upper end to an open lower end disposed axially opposite the closed upper end with the open lower end being positionable over and in concentric alignment with a circular opening in a ceiling panel. Ceiling mounts are carried by the canister wall to provide engagement surfaces for mounting the lamp housing over an opening in an elevator drop-ceiling panel. The downward illumination assembly of the Mandy '617 patent includes a power supply module that is removably supported in an installed position on a side-mounted module receptacle tray of the housing. The power supply module carries two lamp sockets and ballasts that are electrically coupled to the lamp sockets. When the power supply module is in the installed position fluorescent lamps plugged into the two lamp sockets extend into the lamp housing canister through respective lamp openings in the canister wall and will, when illuminated, radiate light out the lower end of the lamp housing canister and through an opening in a drop ceiling panel that the housing is mounted on. The ballasts and sockets carried by the power supply module are serviceable by either lowering the elevator drop ceiling carrying the assembly or by gaining access to the space above the drop ceiling panel and below a top panel or roof of an elevator. Generally, access may be gained to this space by removing an emergency exit door in the top panel of the elevator. In either case, the lamp housing canister is generally left supported on the drop ceiling panel as whatever component requiring servicing is then serviced. However, the lamp sockets and ballasts may first be removed from the lamp housing canister along with the power supply module by unfastening and removing the power supply module and withdrawing the lamps radially outwardly through the lamp openings in the canister wall. However, a downward illumination assembly constructed according to the Mandy '617 patent doesn't allow for removal of the power supply module or servicing of the ballasts and sockets without first having to either lower the ceiling panel carrying the assembly of gaining access to the approximate six inch deep space between the drop ceiling and roof of an elevator.

What would be desirable would be a downward illumination assembly that allows for removal of lamp socket and ballast without having to first lower a ceiling panel carrying the assembly or gaining access to a space between the ceiling panel and a roof disposed above the ceiling panel.

BRIEF SUMMARY OF THE DISCLOSURE

A downward illumination assembly is provided for directing light downward from the ceiling area of a room. The assembly includes a lamp housing having a housing wall extending downwardly to an open lower end configured to be positioned adjacent an opening in a ceiling panel. A power supply module is removably supported in an installed position on the housing and carries a lamp socket such that when the power supply module is in the installed position a lamp plugged into the lamp socket is disposed in a position to radiate light out the lower end of the lamp housing and through an opening in a ceiling panel that the housing is mounted on. The power supply module is configured to be removed interiorly of the lamp housing through the open lower end of the lamp housing. This allows the lamp socket and/or associated wiring to be serviced or replaced from a position below the ceiling panel and without having to remove the lamp housing from the ceiling panel or to disconnect and lower the ceiling panel or a portion of the ceiling panel from a supporting structure.

Also, a method is provided for servicing components housed in the power supply module of the downward illumination assembly when the assembly is carried by a ceiling panel. The method includes gaining access to an interior of the lamp housing through a lower opening of the lamp housing, removing the power supply module from its installed position interiorly of the lamp housing through the lower opening of the lamp housing, servicing a component carried by the power supply module, and returning the power supply module to its installed position on the lamp housing.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which.

DETAILED DESCRIPTION OF INVENTION EMBODIMENT(S)

Figure 1:
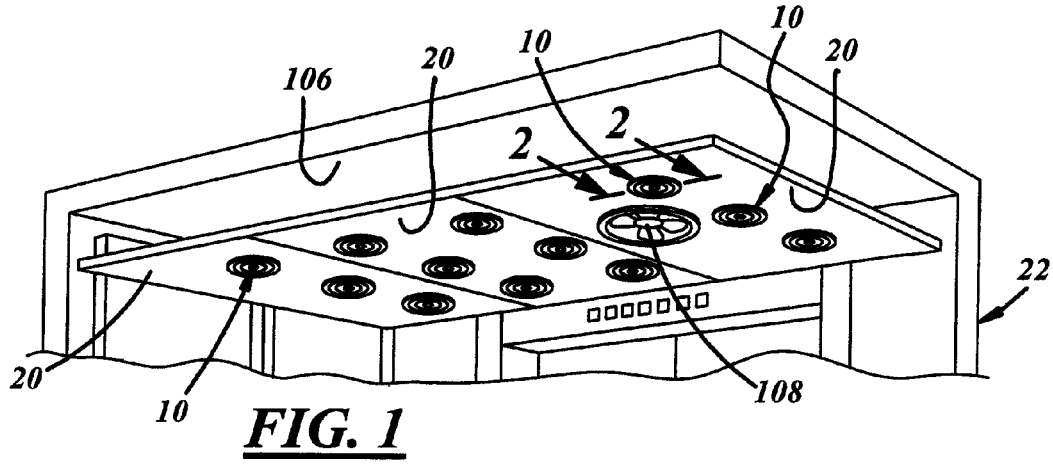
FIG. 1 is a perspective view of a plurality of downward illumination assemblies constructed according to the invention and mounted on a drop ceiling panel in an elevator cab and with two side walls of the elevator having been removed for clarity.

A downward illumination assembly for directing light downward from the ceiling area of a room is generally shown at 10 in the drawings. The assembly 10 may include a lamp housing 12 having a housing wall 14 extending downwardly to an open lower end 16 that is to be positioned adjacent and in general concentric alignment with an opening 18 in a ceiling panel 20 such as a drop ceiling panel 20 of an elevator 22. The assembly 10 may also include a power supply module 24 that is removably supported in an installed position on the lamp housing 12. The power supply module 24 may, in turn, carry two lamp sockets 26 in respective positions such that when the power supply module 24 is in the installed position, lamps 28 plugged into the lamp sockets 26 are disposed in respective positions within the lamp housing 12 to radiate light out the lower end 16 of the lamp housing 12 and through an opening 18 in a ceiling panel 20 that the housing 12 is mounted on. The power supply module 24 may be removable interiorly of the lamp housing 12 through the open lower end 16 of the lamp housing 12 to allow the lamp sockets and/or associated wiring to be serviced or replaced from a position below the ceiling panel 20 and without having to remove the lamp housing 12 from the ceiling panel 20 or to disconnect and lower the ceiling panel 20 or a portion of the ceiling panel 20 from a supporting structure.

Figure 14:
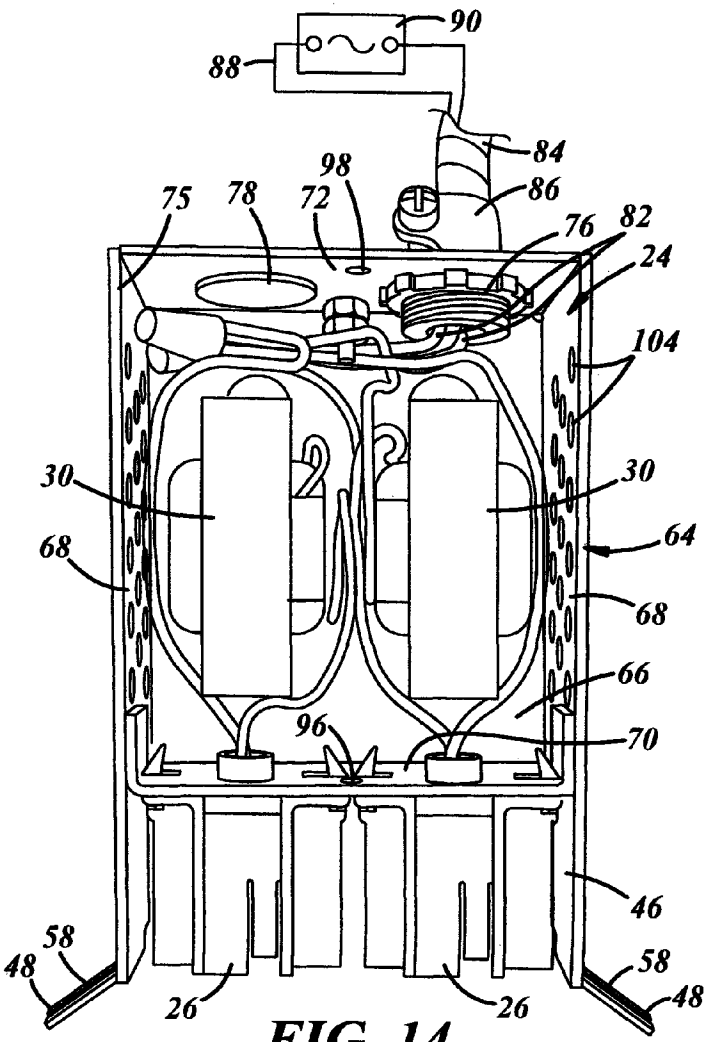
FIG. 14 is a perspective top view of the power supply module of FIG. 10 with the box cover panel of the module enclosure having been removed to reveal components of the power supply module.

As shown in FIGS. 4-8, 10, 11, 13 and 14, the lamp sockets 26 may be of the type that receive fluorescent lamps 28, in which case the assembly 10 may also include one or more ballasts 30. The ballasts 30 may be carried by the power supply module 24 and electrically coupled to the lamp sockets 26 as shown in FIG. 14. The ballasts 30 may thus be removable with the power supply module 24 from the housing 12. As is well known, a ballast 30 provides the proper voltage to establish an arc between the two electrodes of a fluorescent lamp and regulates the electric current flowing through a fluorescent lamp to stabilize light output from the lamp.

As shown in FIGS. 2-9, the housing 12 may include a closed upper end 32 and the housing wall 14 may extend downwardly to the open lower end 16 from around a periphery of the closed upper end 32. The closed housing upper end 32 may be generally circular in shape and the housing wall 14 may, consequently, be generally cylindrical in shape. The closed upper end 32 and generally cylindrical wall 14 of the housing 12 together define the general shape of a downwardly-opening canister.

As shown in FIGS. 4-9, the housing wall 14 may include a module receptacle opening 34 large enough to allow the power supply module 24 to pass completely through the module receptacle opening 34. In the installed position the power supply module 24 may extend through the module receptacle opening 34 with a major portion of the power supply module 24 disposed exteriorly of the lamp housing 12. Disposing a major portion of the power supply exteriorly of the lamp housing 12 minimizes the amount of lamp housing interior space taken up by the power supply module 24 and also limits any interference or disruption the power supply module 24 might cause with the dispersal of light from the lamps 28.

As shown in FIGS. 2-9 and 12, the assembly 10 may further include a side-mounted module receptacle tray 36 carried by the housing wall 14 in alignment with the module receptacle opening 34. The power supply module 24, in the installed position, may be removably supported on the module receptacle tray 36 such that lamps 28 plugged into the lamp sockets 26 will extend into the lamp housing 12 and will, when illuminated, radiate light out the lower end 16 of the lamp housing 12 and through an opening 18 in a ceiling panel 20 that the housing 12 is mounted on.

Figure 9:
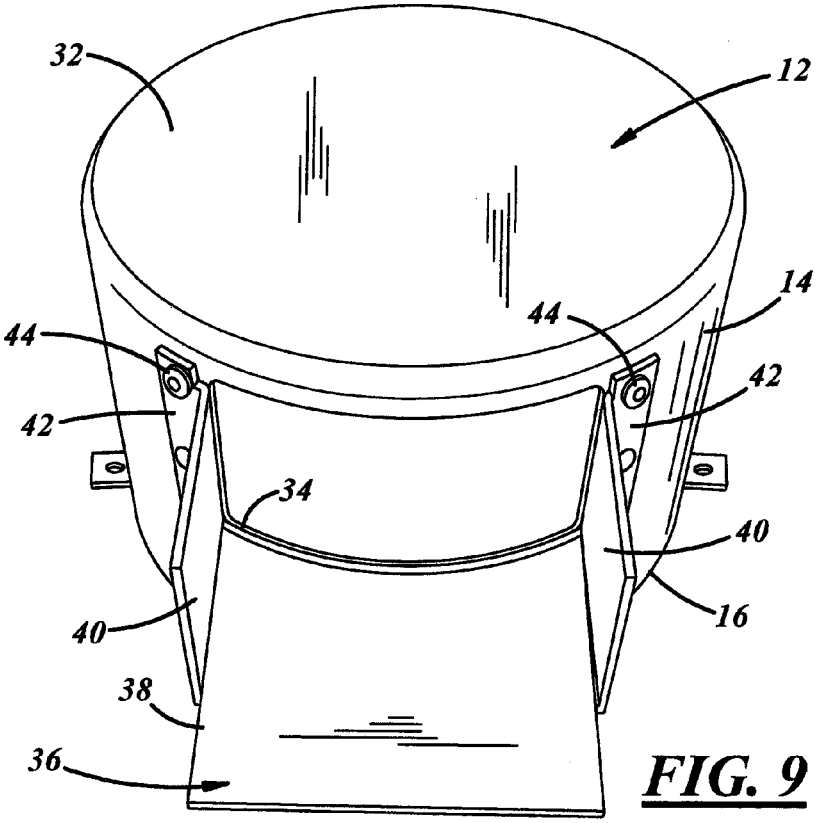
FIG. 9 is a perspective top-left side view of the module receptacle tray of the downward illumination assembly of FIG. 2 supported on the lamp housing of the assembly and with the power supply module of the assembly having been removed.
Figure 10:
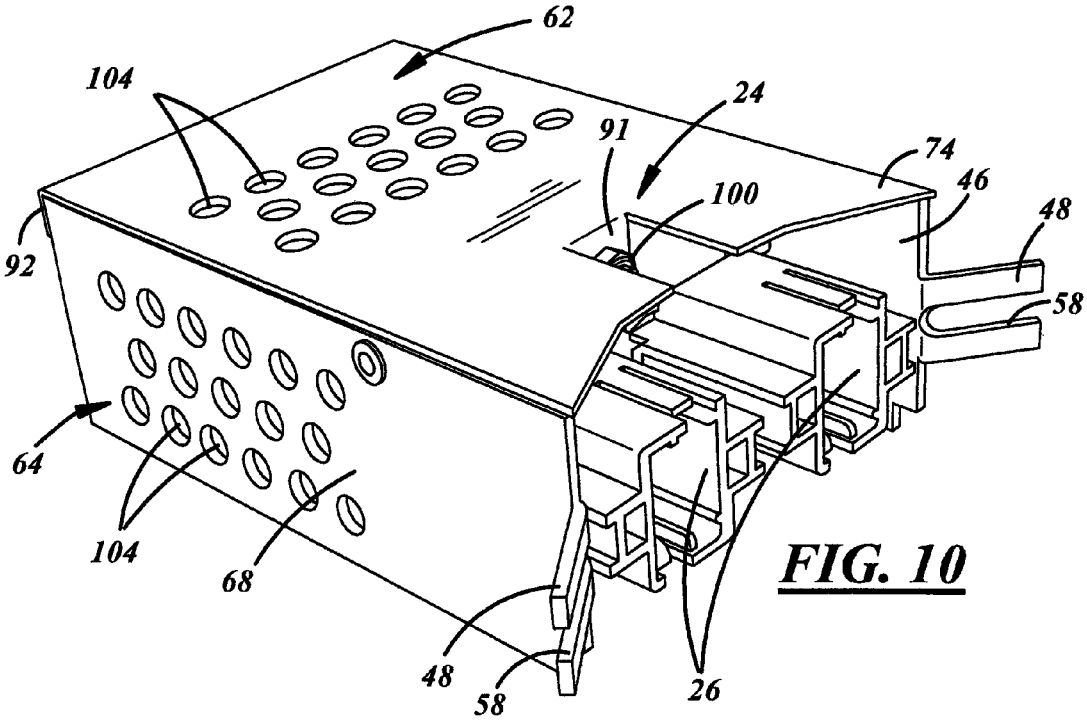
FIG. 10 is a perspective front-top-right side view of the power supply module removed from the downward illumination assembly of FIG. 2.
Figure 11:
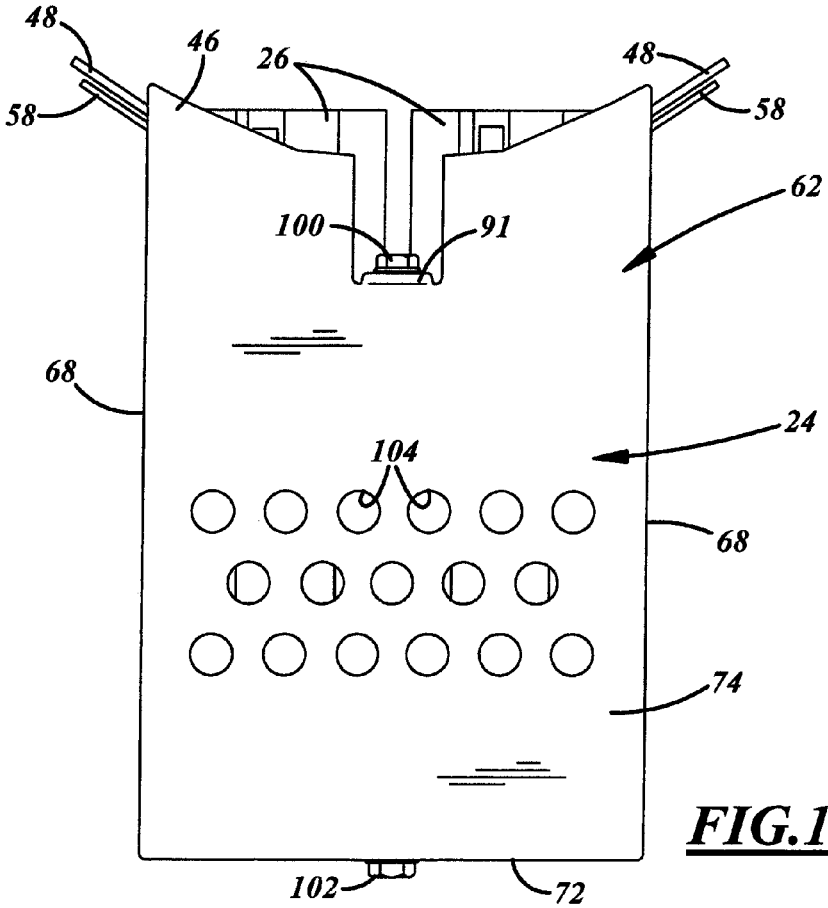
FIG. 11 is a top view of the power supply module of FIG. 10.
Figure 12:
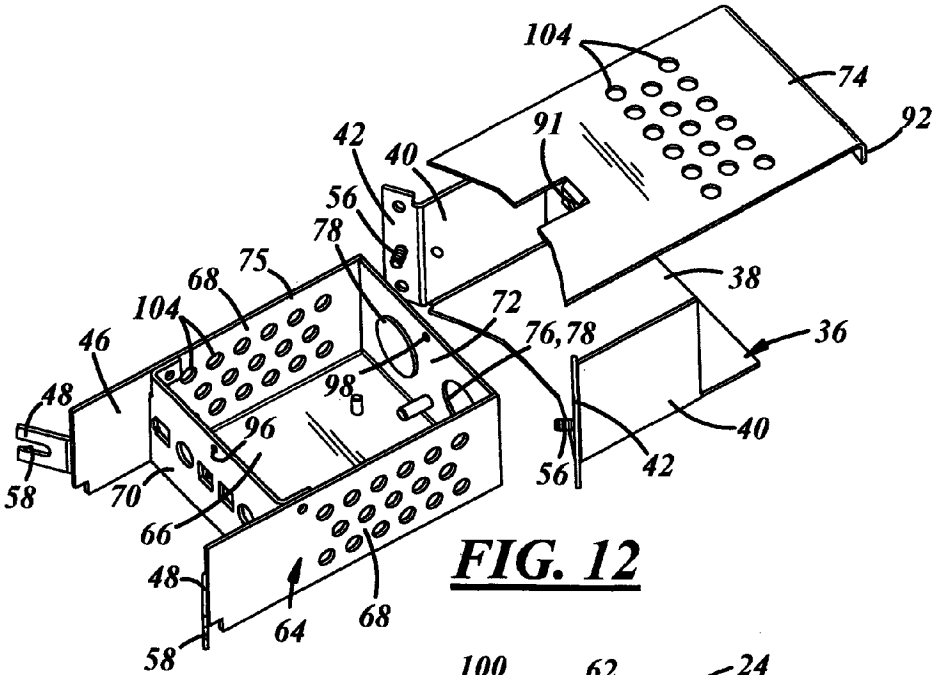
FIG. 12 is a perspective back-top-right side view of a module enclosure of the power supply module of FIG. 10 adjacent the module receptacle tray of the downward illumination assembly of FIG. 2 with a box cover panel of the enclosure shown removed from a box portion of the enclosure.
Figure 13:
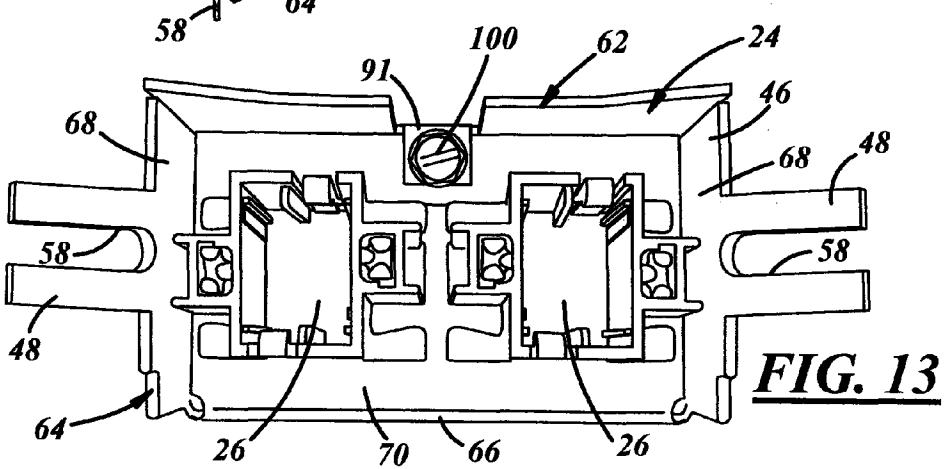
FIG. 13 is a perspective right end view of the power supply module of FIG. 10.

As best shown in FIGS. 9 and 12, the module receptacle tray 36 includes a rectangular floor panel 38 and two rectangular tray side panels 40 that extend integrally upward from along opposite side edges of the floor panel 38 and normal to the floor panel 38. The tray floor panels 38 and tray side panels 40 of the module receptacle tray 36 therefore form a channel of U-shaped cross-section sized to slidably receive the power supply module 24 into the installed position between the tray side panels 40 from a position within the lamp housing 12. The U-shaped channel configuration also allows the power supply module 24 to be slid from the installed position into and through the interior of the lamp housing 12.

As best shown in FIGS. 2, 3, 7, 9, and 12, the module receptacle tray 36 may include two tray mounting tabs 42 that extend outwardly in opposite circumferential directions from the respective tray side panels 40. Each tray mounting tab 42 may be fastened to the housing wall 14 by rivets 44, as shown in the drawings, or by any other suitable means known in the art such as by spot welding the tray mounting tabs 42 to the housing wall 14 or fastening the tray mounting tabs 42 to the housing wall 14 using fasteners such as screws.

Figure 6:
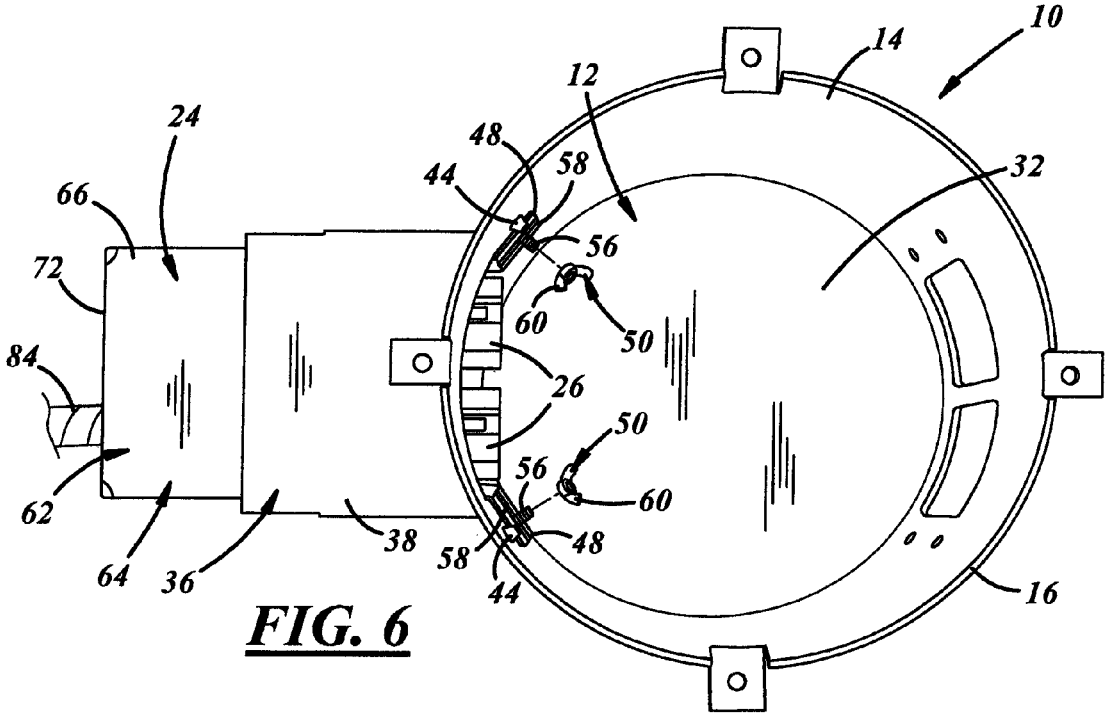
FIG. 6 is a perspective bottom view of the downward illumination assembly of FIG. 2 with the fluorescent bulbs having been removed and wing nut fasteners being removed to free a power supply module of the assembly for removal.

An inner end 46 of the power supply module 24 includes two module mounting tabs 48 positioned to engage the lamp housing wall 14 adjacent the module receptacle opening 34. The module mounting tabs 48 may be positioned to engage or be engaged by respective module fasteners 50. As is best shown in FIGS. 6 and 12, each module fastener 50 may include a threaded post 56 integrally extending from the tray mounting tabs 42 as shown in FIG. 12. When the module receptacle tray 36 is mounted on the lamp housing 12 the threaded posts 56 pass through corresponding openings in the lamp housing wall 14 adjacent opposite side edges of the module receptacle opening 34 as shown in FIG. 6.

As shown in FIGS. 4-8 and 10-14, each module mounting tab 48 may include a slot 58 shaped and positioned to receive one of the two threaded posts 56. The module fasteners 50 may further include respective wing nuts 60 that thread onto the respective posts 56 and secure the module mounting tabs 48 to the lamp housing wall 14 once the power supply module 24 has been moved into the installed position. The wing nuts 60 allow manual threading and unthreaded from the posts 56 to free the power supply module 24 for removal and servicing and preclude the need to use a tool such as a wrench to attach and release the power supply module 24 in the installed position.

The power supply module 24 includes a generally rectilinear box-shaped module enclosure 62. As best shown in FIG. 12, the module enclosure 62 includes a box portion 64 that includes a box bottom panel 66, two opposite box side panels 68, and two opposite box end panels 70, 72. As shown in FIGS. 2, 3, and 10-13, the module enclosure 62 also includes a box cover panel 74 that is removably securable to the box portion 64 of the power supply module 24 to cover a box opening 75 defined by the box side panels 68 and the box end panels 70, 72. The sockets 26 are supported on and extend radially inwardly from a radially inner panel 70 of the two box end panels 70, 72.

Figure 3:
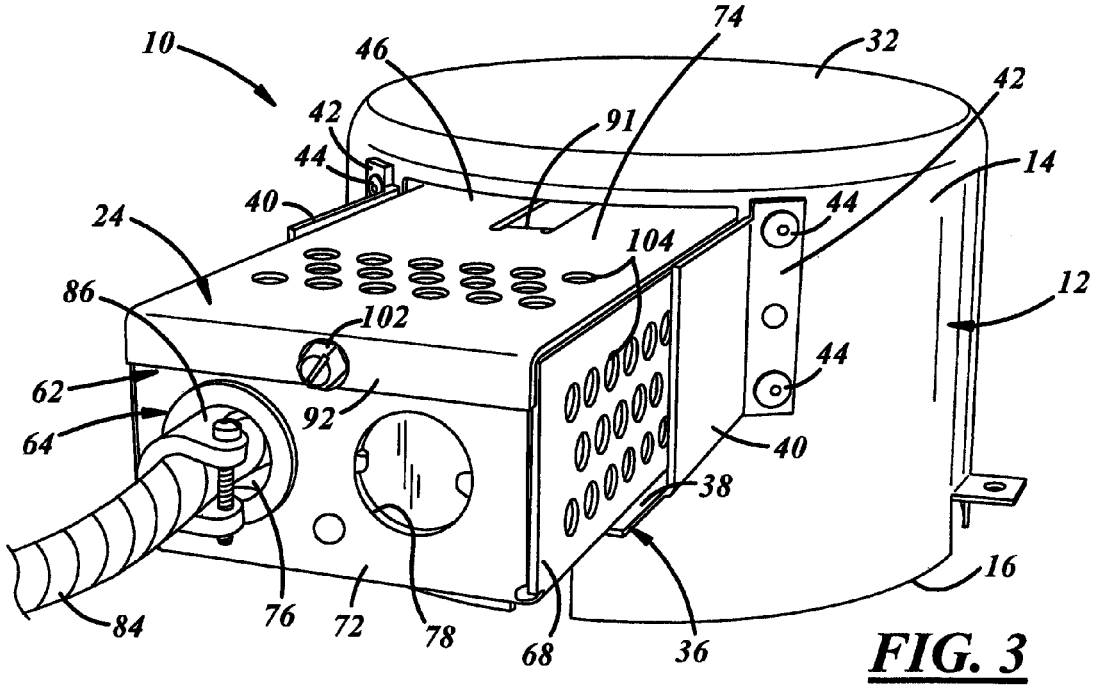
FIG. 3 is perspective front-left end view of the downward illumination assembly of FIG. 2.
Figure 4:
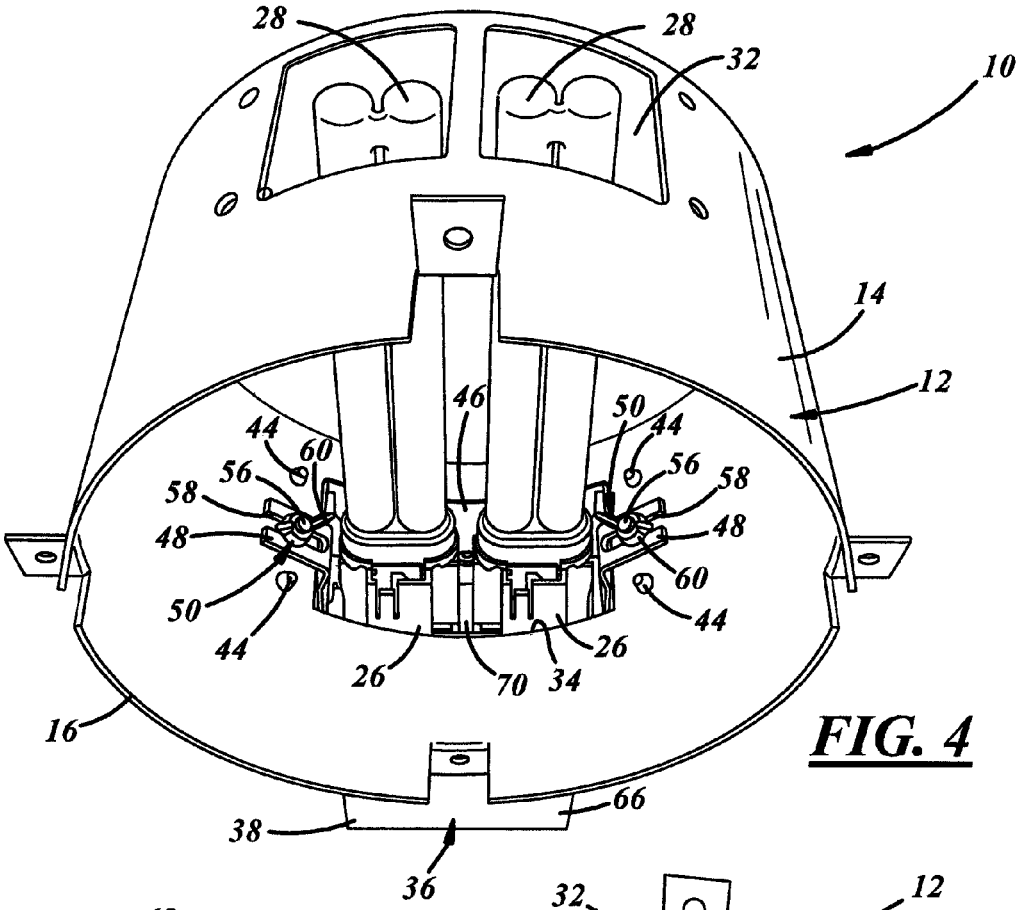
FIG. 4 is perspective bottom-right end view of the downward illumination assembly of FIG. 2.

As shown in FIGS. 3, 12, and 14, the module enclosure 62 may include an electrical power port 76 comprising one of two knockout apertures 78 formed in a radially outer box end panel 72 of the two box end panels 70, 72 of the module enclosure 62. A current path defined by wires 82 carried by a flex conduit 84 may extend through the electrical power port 76. The flex conduit 84 may be secured to the electrical power port 76 by a flex conduit connector 86. The current path 80 may extend from the power supply module 24 to connect the sockets and ballast 30 into an electrical power circuit 88 along with a remote electrical power source 90. The electrical power port 76 is disposed on the outer box end panel 72 of the module enclosure 62 instead of a box side panel of the module enclosure 62 so that the flex conduit 84 and flex conduit connector 86 won't impede the removal of the power supply module 24 through the housing 12 and so that the power supply module 24 can be drawn through the module receptacle opening 34 as the power supply module 24 is removed interiorly of the lamp housing 12.

The module enclosure box cover panel 74 is shaped to be fastened over the box opening 75 in the module enclosure box portion 64 without impeding sliding motion of the power supply module 24 along the module receptacle tray 36. More specifically, and as shown in FIGS. 3 and 10-13, the module enclosure box cover panel 74 includes inner and outer box cover tabs 91, 92 extending downwardly from respective inner and outer edges of the module enclosure box cover panel 74 and normal to the module enclosure box cover panel 74. The inner and outer box cover tabs 91, 92 each include respective tab through-holes aligned with corresponding end panel through-holes 96, 98 in the inner and outer box end panels 70, 72 of the module enclosure box portion 64, respectively. Two screws 100, 102 extend through the respective tab through-holes in the inner and outer box cover tabs 91, 92 and are threadedly engaged in the end panel through-holes 96, 98 in the respective inner and outer box end panels 70, 72 of the module enclosure 62 box portion 64. Because the inner and outer box cover tabs 91, 92 and screws 100, 102 are disposed on end surfaces of the power supply module 24 they provide no obstruction to the sliding motion of the power supply module 24 in the module receptacle tray 36.

The module enclosure 62 includes ventilation holes 104 formed in the box side panels 68 and the box cover panel 74 of the module enclosure 62 to ensure that the ballast 30 doesn't overheat in any installation location, e.g., the space between a roof 106 and drop ceiling panel 20 of an elevator 22. Heat rejection can otherwise be a problem in such an installation location because, as shown in FIG. 1, the roof 106 and drop ceiling panel 20 of an elevator are generally are only six inches apart. Although a fan 108 may be located in the drop ceiling 20 or on the roof 106 of an elevator 22 cab and may be positioned to circulate air through this ceiling space, such fans can be shut off by, for example, a key switch at a control station of the elevator 22 while the lamps 28 are still illuminated and drawing power through the ballast 22.

Figure 2:
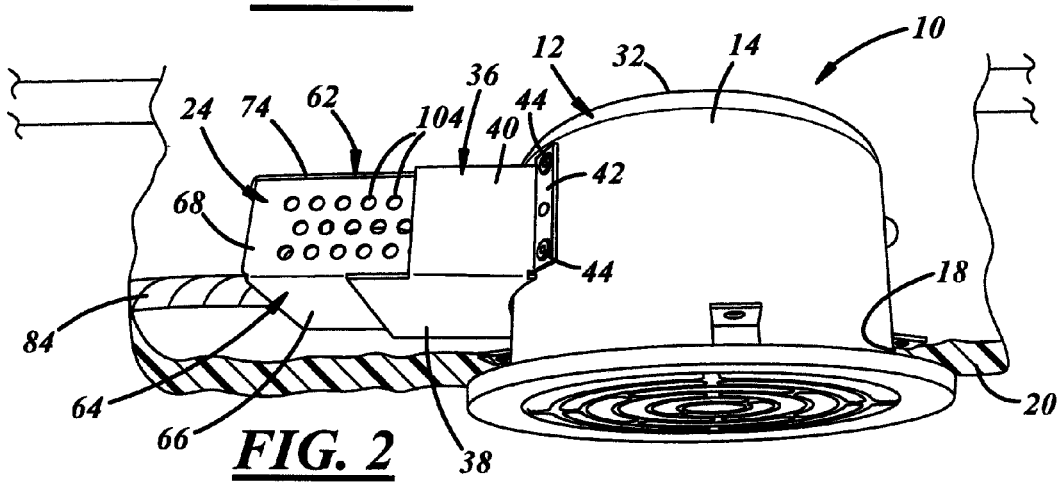
FIG. 2 is a magnified perspective front view of one of the downward illumination assemblies of FIG. 1 with a portion of the drop ceiling panel cut away to reveal more of the assembly.

In practice, a component housed in the power supply module 24 of the downward illumination assembly 10 can be serviced by first gaining access to an interior of the lamp housing 12 through the open lower end 16 of the lamp housing 12. Where, as shown in FIGS. 1 and 2, the assembly 10 includes a covering such as a trim bezel 108 and/or cover lens extending over the open lower end 16 of the lamp housing 12, gaining access to the interior of the lamp housing 12 may include removing the covering from the assembly 10.

Figure 5:
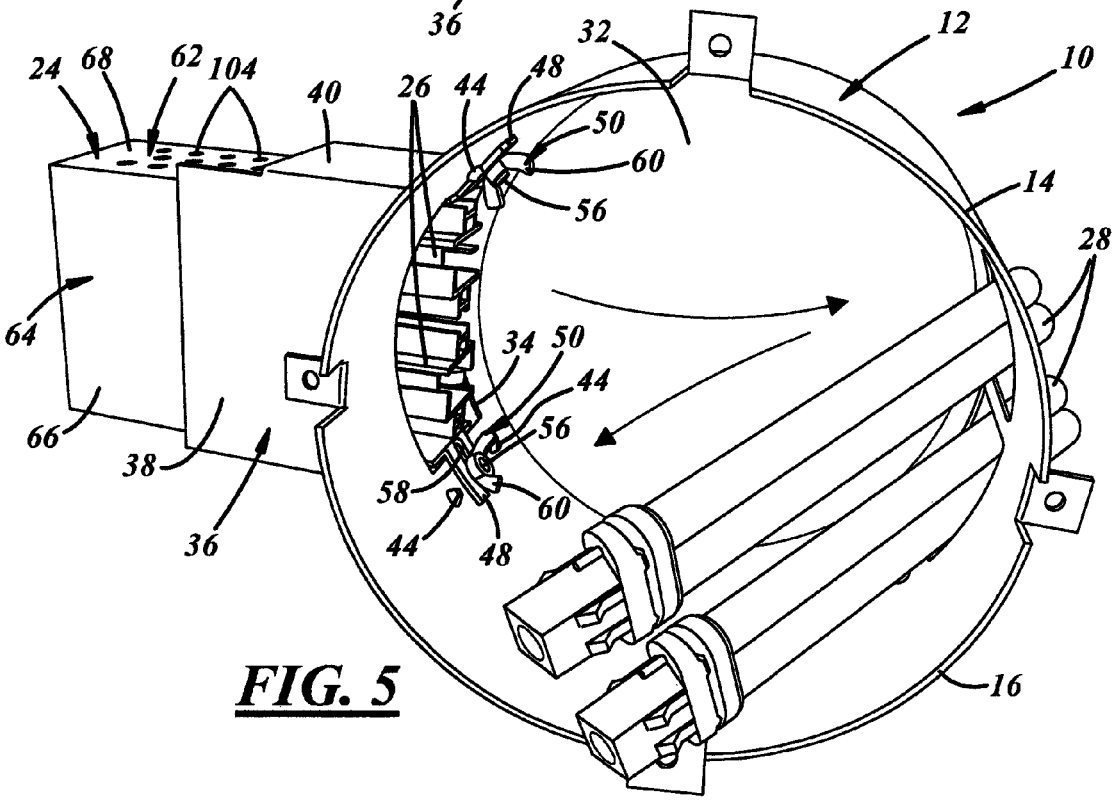
FIG. 5 is a perspective bottom view of the downward illumination assembly of FIG. 2 showing fluorescent bulbs being removed from the assembly.
Figure 7:
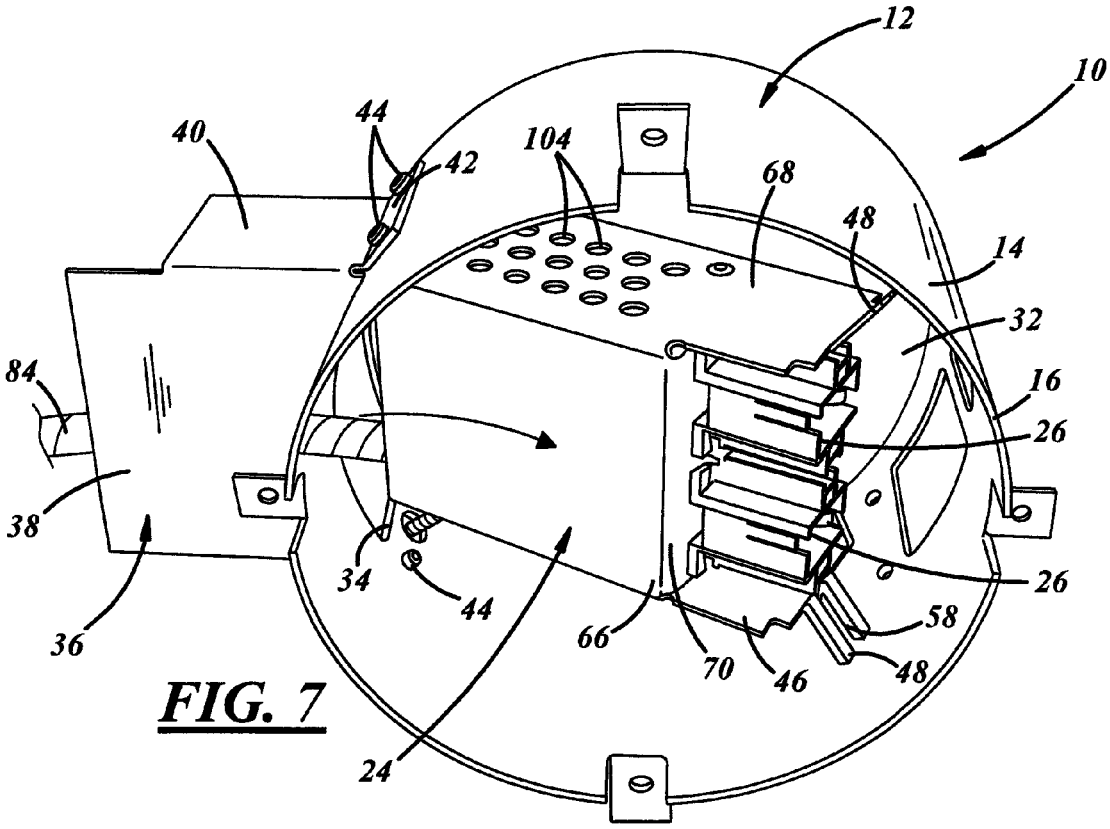
FIG. 7 is a perspective front-bottom view of the downward illumination assembly of FIG. 2 with the power supply module having been slid from a module receptacle tray of the assembly through a module receptacle opening into a lamp housing of the assembly.
Figure 8:
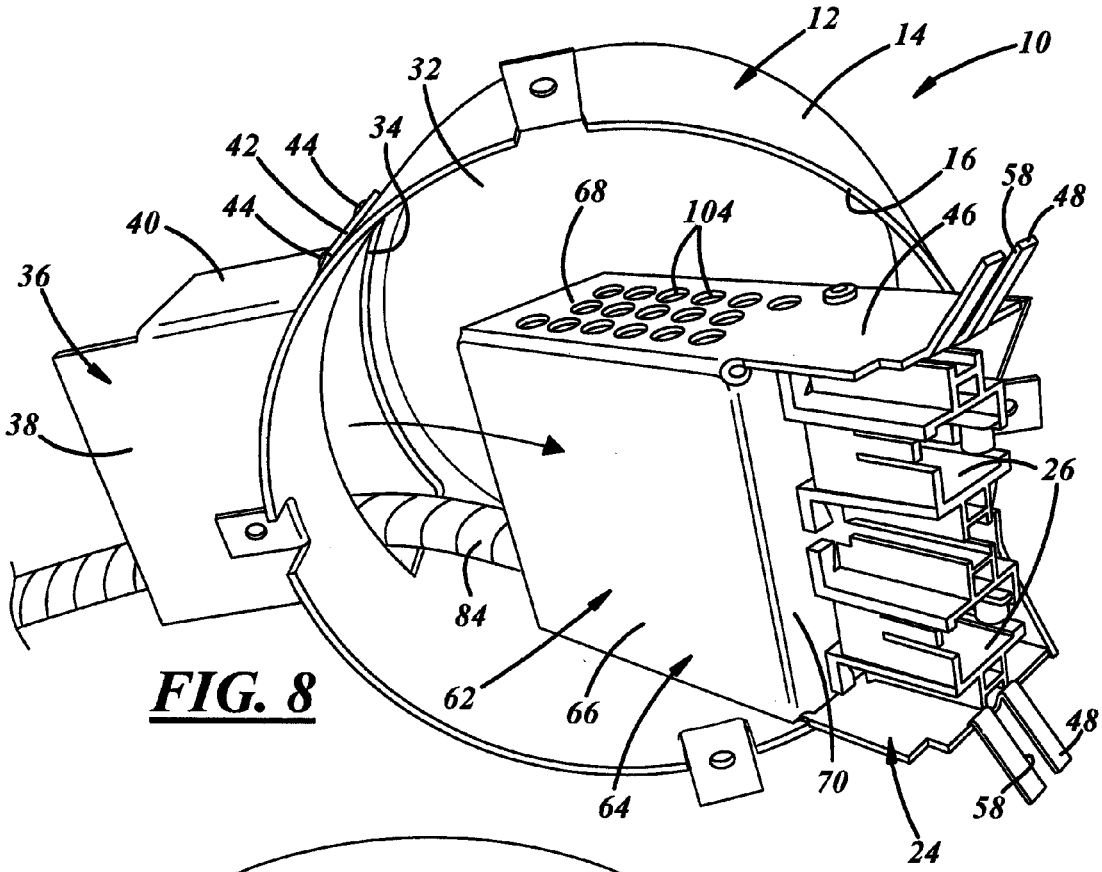
FIG. 8 is a perspective front-bottom view of the downward illumination assembly of FIG. 2 with the power supply module having been drawn out of the lamp housing of the assembly into a position where components of the power supply module can be serviced or replaced.

Any lamps plugged into the power supply module 24 are then unplugged from the module 24 and removed from the assembly 10 as shown in FIG. 5. The power supply module 24 is then removed from its installed position interiorly of the lamp housing 12 through the open lower end 16 of the lamp housing 12. Where the assembly 10 includes module fasteners in the form of wing nuts 60 releasably fastening the power supply module 24 to corresponding threaded posts 56 extending from the housing wall 14, removal of the power supply module 24 includes disengaging the module fasteners by unscrewing the two wing nuts 60 from the threaded posts 56 of the module fasteners as shown in FIG. 6. The power supply module 24 is then withdrawn by sliding the module radially inwardly through the module receptacle opening 34 of the lamp housing 12 as shown in FIG. 7, then out through the open lower end 16 of the lamp housing 12 as shown in FIG. 8.

Whatever power supply module component that requires servicing is then serviced and the power supply module 24 is returned to its installed position on the lamp housing 12. Reinstallation of the power supply module 24 may include passing the power supply module 24 outer end-first through the open lower end 16 of the lamp housing 12, through the module receptacle opening 34, and sliding the power supply module 24 radially outwardly along the module receptacle tray 36 into the installed position. The module fasteners are then re-engaged by screwing the two wing nuts 60 onto the threaded posts 56 of the module fasteners.

This apparatus and method allow a lamp socket and/or associated wiring of a power supply module 24 of a downward illumination assembly 10 to be serviced or replaced from a position below the ceiling panel 20 that the assembly 10 is mounted on—and without having to remove the lamp housing 12 from the ceiling panel 20 or disconnect and lower the ceiling panel 20 or a portion of the ceiling panel 20 from a supporting structure.

This description, rather than describing limitations of an invention, only illustrates one embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A downward illumination assembly for directing light downward from the ceiling area of a room, the assembly comprising:

a lamp housing having a housing interior defined by a housing wall extending downwardly to an open lower end that is configured to be positioned adjacent an opening in a ceiling panel;

a power supply module removably supported in an installed position in which at least a portion of the power supply module is disposed outside the lamp housing, the lamp housing including a power supply module receptacle opening formed in the housing wall and shaped to allow the power supply module to pass through between the installed position and the housing interior;

a lamp socket carried by the power supply module and configured to carry a lamp in a position to radiate light out the open lower end of the lamp housing when the power supply module is in the installed position, and a module support surface positioned and configured to support the power supply module as the module is moved between the installed position and the lamp housing interior so that the power supply module can be installed and removed interiorly of the lamp housing through the open lower end of the lamp housing.

2. A downward illumination assembly as defined in claim 1 in which:

the lamp socket is configured to receive a fluorescent tube; and the assembly includes a ballast that is carried by the power supply module and is electrically coupled to the lamp socket; the ballast being removable with the power supply module from the housing.

3. A downward illumination assembly as defined in claim 1 in which the assembly includes two sockets, each configured to removably receive a fluorescent tube.

4. A downward illumination assembly as defined in claim 1 in which the housing includes a closed upper end and the housing wall extends downwardly to the open lower end from around a periphery of the closed upper end.

5. A downward illumination assembly as defined in claim 1 in which:

the assembly includes a side-mounted module receptacle tray carried by the housing wall in alignment with the module receptacle opening and including the module support surface, and the power supply module, in the installed position, is removably supported on the module receptacle tray such that a lamp plugged into the lamp socket will extend into the lamp housing.

6. A downward illumination assembly as defined in claim 5 in which:

the module receptacle tray includes a floor panel and two side panels extending integrally upward from along opposite side edges of the floor panel; and the two side panels are spaced to receive the power supply module into the installed position between the side panels on the receptacle tray from a position within the lamp housing and to allow the power supply module to be moved from the installed position on the receptacle tray to a position within the lamp housing.

7. A downward illumination assembly as defined in claim 6 in which the module receptacle tray includes at least one tray mounting tab extending circumferentially outwardly from at least one of the side panels of the tray, the tray mounting tab being fastened to the housing wall.

8. A downward illumination assembly as defined in claim 1 in which an inner end of the power supply module includes at least one module mounting tab positioned to engage the lamp housing wall adjacent the module receptacle opening.

9. A downward illumination assembly as defined in claim 8 in which the module mounting tab is positioned to engage a module fastener mounted on an inner surface of the lamp housing wall adjacent the module receptacle opening.

10. A downward illumination assembly as defined in claim 9 in which:

the module fastener includes a threaded post;

the mounting tab includes an opening configured to receive the threaded post; and the module fastener further includes a nut configured to thread onto the post and secure the mounting tab to the lamp housing wall and to unthread from the posts to free the power supply module for removal.

11. A downward illumination assembly as defined in claim 1 in which the power supply module includes a module enclosure including a box portion having a box opening and a cover panel removably securable over to the box portion over the box opening.

12. A downward illumination assembly as defined in claim 11 in which:

the module enclosure includes an electrical power port disposed in a radially outer one of two end panels of the module enclosure; and at least one current path is connected to the socket and extends from the power supply module through the electrical power port and is connectable to complete an electrical power circuit comprising the socket and an electrical power source.

13. A downward illumination assembly as defined in claim 11 in which the module enclosure cover is configured to be fastened to the module enclosure box portion without impeding sliding motion of the power supply module along the module receptacle tray.

14. A downward illumination assembly as defined in claim 11 in which the module enclosure includes ventilation holes.

15. A downward illumination assembly for directing light downward from the ceiling area of a room, the assembly comprising:

a lamp housing having a housing wall extending downwardly to an open lower end configured to be positioned adjacent an opening in a ceiling panel, the closed housing upper end being generally circular in shape, the housing wall being generally cylindrical in shape, and the upper end and wall defining a downwardly opening canister;

a power supply module removably supported in an installed position in which at least a portion of the power supply module is disposed outside the housing;

a lamp socket carried by the power supply module such that when the power supply module is in the installed position at least a portion of a lamp plugged into the lamp socket is disposed inside the lamp housing in a position to radiate light out the open lower end of the lamp housing and through an opening in a ceiling panel that the housing is mounted on, and the housing wall includes a power supply module receptacle opening spaced from the open lower end configured to allow the power supply module to be removed interiorly of the lamp housing by drawing the module into the lamp housing through the aperture into a position from which the module may then be removed through the open lower end of the lamp housing.

16. A downward illumination assembly as defined in claim 15 in which the housing wall includes a module receptacle opening large enough to allow the power supply module to pass completely through the module receptacle opening.

17. A downward illumination assembly as defined in claim 15 in which at least a portion of the power supply module is disposed exteriorly of the lamp housing in the installed position.

18. A method for removing and installing a power supply module of a downward illumination assembly that is carried by a ceiling panel, the method including the steps of:

providing a downward illumination assembly comprising a lamp housing having a housing interior defined by a housing wall extending downwardly to an open lower end, and a power supply module removably supported in an installed position in which at least a portion of the power supply module is disposed outside the housing;

gaining access to the housing interior through the open lower end of the lamp housing;

removing the power supply module from the assembly from its installed position by passing the module into the lamp housing interior and then out through the open lower end of the lamp housing; and installing a power supply module in the assembly by passing the module into the housing interior through the open lower end of the lamp housing and then into its installed position on the lamp housing.

19. The method of claim 18 in which, where the step of providing a downward illumination assembly includes providing a covering over an open lower end of the lamp housing, the step of gaining access to the housing interior through the open lower end of the lamp housing includes removing the covering from the assembly.

20. The method of claim 18 in which, where the step of providing a downward illumination assembly includes providing at least one module fastener for releasably fastening the power supply module of the assembly to the lamp housing wall of the assembly, the step of removing the power supply module includes disengaging the module fastener.

21. The method of claim 18 in which the step of providing a downward illumination assembly includes providing at least one module fastener configured to releasably fasten the power supply module to the housing wall, and the step of returning the power supply module to its installed position includes engaging the module fastener.

* * * * *